US006712091B2

(12) United States Patent
Linser

(10) Patent No.: US 6,712,091 B2
(45) Date of Patent: Mar. 30, 2004

(54) CONTROL DEVICE FOR A HYDRAULIC CONTROL MOTOR

(75) Inventor: Jörg Linser, Heubach-Lautern (DE)

(73) Assignee: ZF Lenksysteme GmbH, Schwaebisch Gmuend (DE)

( * ) Notice: Subject to any disclaimer, the term of this patent is extended or adjusted under 35 U.S.C. 154(b) by 44 days.

(21) Appl. No.: 10/203,314

(22) PCT Filed: Jan. 20, 2001

(86) PCT No.: PCT/EP01/00628

§ 371 (c)(1),
(2), (4) Date: Aug. 6, 2002

(87) PCT Pub. No.: WO01/59305

PCT Pub. Date: Aug. 16, 2001

(65) Prior Publication Data

US 2003/0010194 A1 Jan. 16, 2003

(30) Foreign Application Priority Data

Feb. 11, 2000 (DE) ..... 100 06 141

(51) Int. Cl.[7] ..... F15B 13/042
(52) U.S. Cl. ..... 137/596.15; 137/596.16
(58) Field of Search ..... 91/454; 137/596.14, 137/596.15, 596.16

(56) References Cited

U.S. PATENT DOCUMENTS 3,714,868 A 2/1973 Kowalski et al.
3,838,710 A 10/1974 Reip
4,111,226 A 9/1978 Cameron
5,331,883 A * 7/1994 Andersson ..... 137/596.15

FOREIGN PATENT DOCUMENTS

| | | |
|---|---|---|
| CH | 535 384 | 5/1973 |
| DE | 1 095 203 | 12/1960 |
| DE | 38 12 116 | 10/1989 |
| DE | 92 02 938 | 6/1992 |
| DE | 44 22 742 | 1/1996 |
| DE | 44 46 144 | 6/1996 |
| DE | 196 24 884 | 1/1997 |
| DE | 195 35 898 | 4/1997 |
| DE | 195 36 553 | 4/1997 |
| DE | 196 34 319 | 2/1998 |
| DE | 100 06 141 | 9/2001 |
| EP | 0 091 018 | 10/1983 |
| GB | 2 212 220 | 7/1989 |
| WO | 96/21807 | 7/1996 |

OTHER PUBLICATIONS

Werner Goetz: "Hydraulik In Theorie Und Praxis", Schulung, Stuttgart: Bosch GmbH, DE, 1995, pp. 239–243.

* cited by examiner

*Primary Examiner*—Gerald A. Michalsky
(74) *Attorney, Agent, or Firm*—Kenyon & Kenyon

(57) ABSTRACT

A control device for a hydraulic control motor includes at least one valve controlled actively by an actuating force and at least one passive valve which is operatively connected to the actively controlled valve and which is co-controlled via a line.

5 Claims, 1 Drawing Sheet

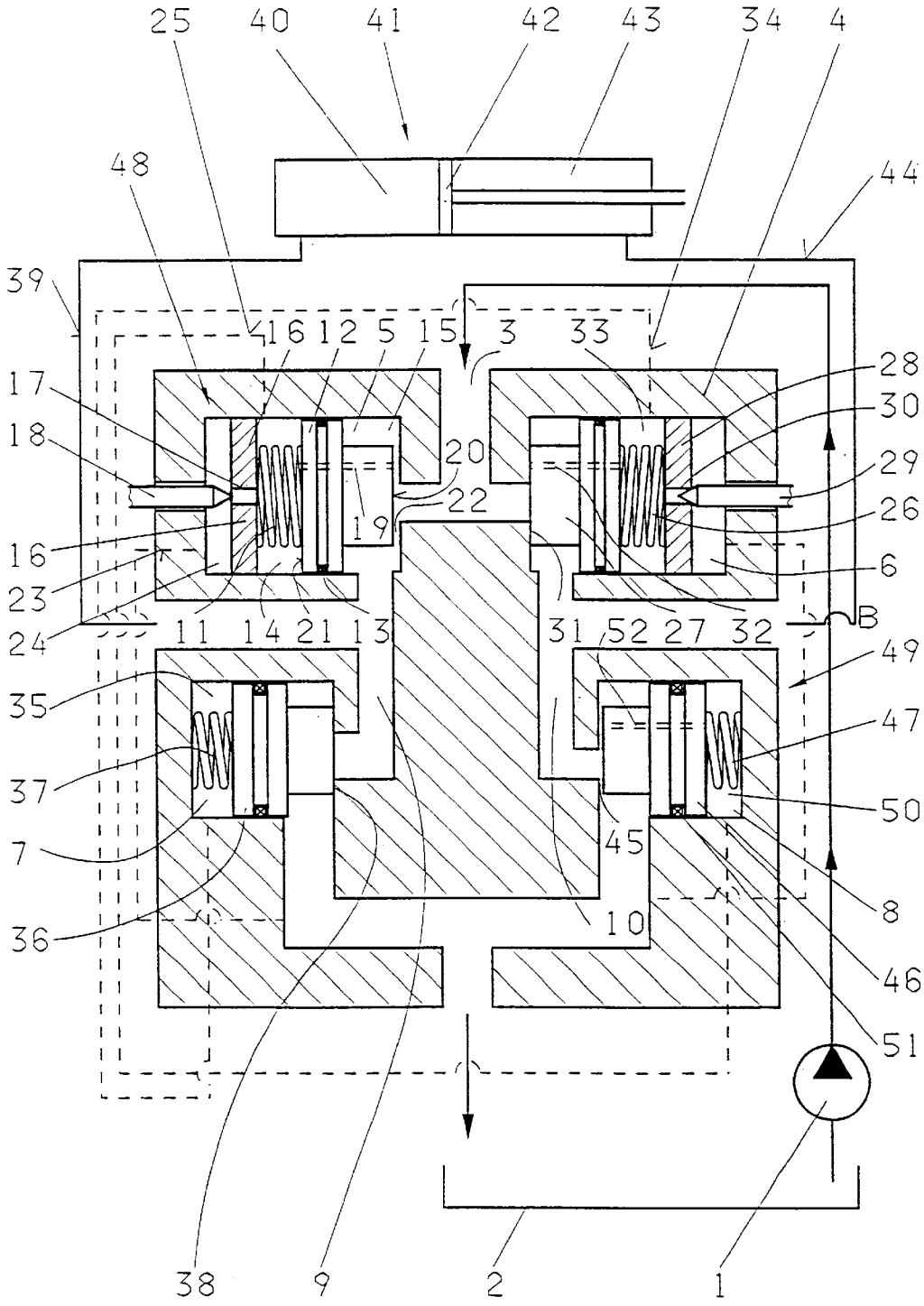
Fig.

CONTROL DEVICE FOR A HYDRAULIC CONTROL MOTOR

FIELD OF THE INVENTION

The invention relates to a control device.

BACKGROUND INFORMATION

U.S. Pat. No. 3,714,868 describes a control device that operates on the closed-center principle.

It is an object of the present invention to provide a control device configured to operate on the open-center principle and which substantially avoids leakages. The control device may be constructed in a simple manner, may operate reliably and may be produced without a high outlay in manufacturing terms.

SUMMARY

The above and other beneficial objects of the present invention are achieved by providing a control device as described herein.

In accordance with the present invention, quantity-independent functioning may be ensured. The control device according to the present invention may be used for various applications and may easily be adapted to changed requirements. It may be used, for example, for a hydraulic control motor, e.g., when the activation of the latter functions on the open-center principle.

Example embodiments of the present invention are described herein. However, the present invention is not restricted to the feature combinations described herein but include further appropriate possibilities for the combination of features.

The present invention may allow a modular construction of the, e.g., electrohydraulic control device, so that a large number of parts may be used many times, which may provide considerable advantages with regard to the outlay in terms of manufacturing and assembly terms. By virtue of the simple construction, standard seals may be used, which do not place stringent requirements on the components in terms of tolerances and surface quality. In addition, the use of special materials may be dispensed with, which may be advantageous with regard to heat treatment and surface treatment. At the same time, high flexibility for various applications is preserved. Particularly reliable functioning may be ensured in that no moveable parts are mounted one in the other. When the control device according to the present invention is used for a hydraulic control motor, the latter may be activated on the open-center or closed-center principle.

A control device according to the present invention for a hydraulic control motor has at least one valve which is controlled actively by an actuating force and which has a first piston with stepped diameters, which is mounted axially moveably in a housing and is loaded by a spring and which forms a first pressure space with an, e.g., disk-shaped element having a throttle point. Furthermore, such a control device has at least one passive valve which is operatively connected to the actively controlled valve and which has a second piston with stepped diameters, which is mounted axially moveably in the housing and is loaded by a spring and which forms with the housing a second pressure space. These two pressure spaces are operatively connected via a line, so that the actively controlled valve co-controls the passive valve. The actively controlled valve has an adjustable throttle point which may be regulated actively by a throttle needle. The actuating force which regulates the throttle point may be applied mechanically, electrically, electromagnetically, hydraulically, pneumatically, etc. The pistons have special sealing elements which, in addition to performing their sealing function, also have bearing properties. They may be produced from resistant and low-wear materials, such as, for example, Teflon. Integrated in the piston of the actively controlled valve is at least one bore which serves for the feed of pressure medium into a pressure space which is connected to the passive valve by a line.

An exemplary embodiment of the present invention is described below, in principle, with reference to the FIGURE.

BRIEF DESCRIPTION OF THE DRAWING

The FIGURE illustrates a control device according to the present invention which controls a hydraulic control motor.

DETAILED DESCRIPTION

A pressure medium conveyed out of a tank 2 by a pump 1 flows through an inflow bore 3 into a housing 4 having a plurality of bores 5,6,7,8 which are connected via lines 9,10. A piston 12 loaded by a spring 11 is mounted axially moveably in the bore 5. The piston 12 has a stepped outside diameter. A sealing element 13 in the piston 12 separates the bore 5 into two pressure spaces 14, 15. The sealing element 13 also serves at the same time for the low-friction guidance of the piston 12. The spring 11 is supported on a disk-shaped element 16 connected firmly to the housing 4. The disk-shaped element 16 has a throttle point 17 which co-operates with a throttle needle 18 axially displaceable by an actuating force and thus allows a change in volume flow.

The pressure medium flowing through the throttle point 17 flows through a further pressure space 24 and via a line 23 back to the tank. If, for example, the volume flow in the inflow bore 3 is to be reduced or interrupted, the throttle needle 18 is pushed into the throttle point 17. The pressure medium then has to flow through a bore 19 arranged in the piston 12. Due to the smaller throughflow cross-section of the throttle points 17, there is a pressure build-up in the pressure space 14. Beyond a defined pressure in the pressure space 14, a force equilibrium occurs between the pressure forces acting on end faces 20 and 21. The spring 11 has the task of pushing the piston 12, in the neutral position, against the housing 4 so that, due to the throttling of the volume flow of the pressure medium in an annular gap 22, a predetermined pressure difference may arise, which, when a throttle effect occurs at the throttle point 17, brings about, on the end face 21 of the piston 12, a pressure force which overcomes the friction of the sealing element 13. When the force equilibrium is reached, the piston 12 moves in the direction of the inflow bore 3 due to the force of the spring 11. The annular gap 22 located between the housing 4 and the end face 20 is thereby narrowed. As a result, the pressure of the pressure medium of the inflow bore 3 rises. The actuating force on the throttle needle 18 corresponds in amount to the pressure of the pressure medium in the pressure space 14, which, in turn, corresponds to the pressure of the pressure medium in the inflow bore 3. This gives rise to proportionality between the actuating force acting on the throttle needle 18 and the pressure of the pressure medium which is established in the inflow bore 3. A further piston 27 pressure-loaded by a spring 26 is located in the bore 6 in the housing 4. The spring 26 is supported on a disk-shaped element 28.

If the pressure medium is to be led to a pressure space 40 of a hydraulic control motor 41 via a line 39, then a throttle needle 29 may close a throttle point 30, with the result that an annular gap 31 is closed. The pressure medium flows through a bore 32 into a pressure space 33 and from there further on, via a line 34, into a pressure space 35 which is formed by a piston 36, axially displaceable in the bore 7, and the housing 4. The piston 36 pressure-loaded by a spring 37 closes an annular gap 38. A piston 42 of the hydraulic control motor 41 is displaced and the pressure medium is led further on from a second pressure space 43 via a line 44 to the line 10 in the housing 4. The pressure medium may flow off to the tank 2 via an open annular gap 45 which occurs between the housing 4 and a piston 46 axially displaceable in the bore 8 and loaded by a spring 47.

A pressure space 50, which is formed by the housing 4 and the piston 46 pressure-loaded by a spring 47, is operatively connected to the pressure space 14 via a line 25.

An actively controlled valve 48 thus at the same time also controls a passive valve 49. A bore 52 may be provided, in addition, in the piston 46 of the passive valve 49, in order to return the pressure medium into the pressure space 14.

REFERENCE SYMBOLS

1. Pump
2. Tank
3. Inflow bore
4. Housing
5. Bore
6. Bore
7. Bore
8. Bore
9. Line
10. Line
11. Spring
12. Piston
13. Sealing element
14. Pressure space
15. Pressure space
16. Disk-shaped element
17. Throttle point
18. Throttle needle
19. Bore
20. End face
21. End face
21. End face
22. Annular gap
23. Line
24. Pressure space
25. Line
26. Spring
27. Piston
28. Disk-shaped element
29. Throttle needle
30. Throttle point
31. Annular gap
32. Bore
33. Pressure space
34. Line
35. Pressure space
36. Piston
37. Spring
38. Annular gap
39. Line
40. Pressure space
41. Hydraulic control motor
42. Piston
43. Pressure space
44. Line
45. Annular gap
46. Piston
47. Spring
48. Valve
49. Valve
50. Pressure space
51. Sealing element
52. Bore

What is claimed is:

1. A control device for a hydraulic control motor, comprising:

a housing;

an element having a throttle point;

at least one first valve including a first piston having a stepped diameter, the first piston mounted axially movably and loaded by a first spring, the first valve controllable in accordance with an actuating force, the first piston and the element arranged relative to the housing to form a first pressure space; and at least one a second valve including a second piston having a stepped diameter, the second piston mounted axially movably and loaded by second a spring, the second piston arranged relative to the housing to form a second pressure space hydraulically connected to the first pressure space via a line so that the second valve is arranged to be co-controlled by the first valve;

wherein the control device is configured to operate in accordance with an open-center principle; and wherein at least one of the first piston and the second piston includes a bore configured to feed pressure medium to a respective pressure space, the bore arranged so that the bore is closed when the at least one of the first piston and the second piston is pressed against the housing to avoid leakage.

2. The control device according to claim 1, further comprising a throttle needle, the first valve controllable via the throttle point in accordance with the throttle needle.

3. The control device according to claim 1, further comprising an arrangement configured to generate an actuating force at least one of mechanically, electrically, electromagnetically, hydraulically and pneumatically.

4. The control device according to claim 1, wherein each of the first piston and the second piston includes a sealing element configured to seal and mount.

5. The control device according to claim 1, further comprising a first line path and a second line path, the first line path and the second line path arranged in parallel between an inflow for a hydraulic pressure medium and a tank;

wherein, in a direction of flow of the pressure medium during operation, each of the first line path and the second line path includes a respective first valve followed by a respective second valve, each second valve configured to be co-controlled by the first valve arranged in an opposite one of the first line path and the second line path.

* * * * *

UNITED STATES PATENT AND TRADEMARK OFFICE

CERTIFICATE OF CORRECTION

PATENT NO. : 6,712,091 B2
DATED : March 30, 2004
INVENTOR(S) : Joerg Linser

It is certified that error appears in the above-identified patent and that said Letters Patent is hereby corrected as shown below:

Column 4,
Line 25, change "at least one a second valve" to -- at least one second valve --.

Signed and Sealed this

Twenty-ninth Day of March, 2005

JON W. DUDAS
*Director of the United States Patent and Trademark Office*